US010686282B1

(12) United States Patent
McCarthy et al.

(10) Patent No.: US 10,686,282 B1
(45) Date of Patent: Jun. 16, 2020

(54) ELECTRICAL CONNECTOR FOR MITIGATING ELECTRICAL RESONANCE

(71) Applicant: TE CONNECTIVITY CORPORATION, Berwyn, PA (US)

(72) Inventors: Sean Patrick McCarthy, Palmyra, PA (US); Leonard Henry Radzilowski, Palo Alto, CA (US); Timothy Robert Minnick, Enola, PA (US); Justin Dennis Pickel, Hummelstown, PA (US); Arturo Pachon Munoz, San Jose, CA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/287,283

(22) Filed: Feb. 27, 2019

(51) Int. Cl.
*H01R 13/6585* (2011.01)
*H01R 13/6471* (2011.01)

(52) U.S. Cl.
CPC ..... *H01R 13/6585* (2013.01); *H01R 13/6471* (2013.01)

(58) Field of Classification Search
CPC ..... H01R 13/6585; H01R 13/6588; H01R 23/688; H01R 23/7073; H01R 13/1471
USPC ..... 439/607.05, 607.08–607.1
See application file for complete search history.

(56) References Cited

U.S. PATENT DOCUMENTS 6,267,625 B1 7/2001 Gugliotti et al.
6,786,771 B2 9/2004 Gailus
7,371,117 B2 5/2008 Gailus
8,777,663 B2 * 7/2014 Annis ..... H01R 13/514 439/607.05
8,998,642 B2 4/2015 Manter et al.
9,300,074 B2 3/2016 Gailus
9,570,857 B2 * 2/2017 Morgan ..... H01R 13/6585
9,705,255 B2 7/2017 Atkinson et al.
9,748,698 B1 * 8/2017 Morgan ..... H01R 13/6587
10,276,958 B1 * 4/2019 Mason ..... H01R 13/6471
2006/0068640 A1 * 3/2006 Gailus ..... H01R 13/719 439/607.08
2009/0291593 A1 * 11/2009 Atkinson ..... H01R 13/6471 439/607.06
2013/0109232 A1 * 5/2013 Paniaqua ..... H01R 13/6581 439/607.07
2015/0236451 A1 * 8/2015 Cartier, Jr. ..... H01R 13/6585 439/607.05
2016/0336692 A1 * 11/2016 Champion ..... H01R 13/6471
2017/0069986 A1 * 3/2017 Horning ..... H01R 12/7076
2017/0170606 A1 * 6/2017 Phillips ..... H01R 13/6585
(Continued)

*Primary Examiner* — Gary F Paumen

(57) ABSTRACT

An electrical connector includes a housing, signal contacts, and ground shields. The housing has a base wall that defines openings therethrough. The signal contacts are arranged in pairs and project through at least some of the openings beyond a top side of the base wall. The ground shields project through at least some of the openings beyond the top side of the base wall. Each ground shield has at least two walls and at least partially surrounds a corresponding pair of the signal contacts. Each ground shield has an inner side that faces the corresponding pair of signal contacts and an outer side that is opposite the inner side. The outer sides of the ground shields have a lossy coating to absorb electrical resonances, and the inner sides of the ground shields lack the lossy coating.

20 Claims, 4 Drawing Sheets

(56) References Cited

U.S. PATENT DOCUMENTS

| | | | | |
|---|---|---|---|---|
| 2018/0233857 | A1 | 8/2018 | Pickel et al. | |
| 2019/0013625 | A1* | 1/2019 | Gailus ..... | H01R 12/7076 |

* cited by examiner

ELECTRICAL CONNECTOR FOR MITIGATING ELECTRICAL RESONANCE

BACKGROUND OF THE INVENTION

The subject matter herein relates generally to electrical connectors, and more specifically to connectors that mitigate electrical resonance by absorbing and dissipating electrical energy along ground conductors of the connectors.

Some electrical connector systems utilize electrical connectors, such as board-mounted connectors, cable-mounted connectors, or the like, to interconnect two circuit boards, such as a motherboard and daughter card. Some known electrical connectors have electrical problems, particularly when transmitting at high data rates. For example, some electrical connectors utilize differential pair signal conductors to transfer high speed signals. Ground conductors improve signal integrity by providing electrical shielding around the signal conductors. However, electrical performance of known electrical connectors is inhibited by resonance spikes at certain frequencies when transmitting high speed electrical signals, even with the presence of ground conductors. For example, electrical resonances (e.g., electrical current resonating along the conductors) may propagate along the current path defined by the ground conductors, reflecting back and forth along the lengths of the conductors to cause a standing wave that degrades the signal transmission performance of the electrical connectors.

A need remains for an electrical connector with satisfactory signal integrity (e.g., quality) at high transfer speeds and frequencies by mitigating electrical resonances.

BRIEF DESCRIPTION OF THE INVENTION

In one or more embodiments, an electrical connector is provided that includes a housing, signal contacts, and ground shields. The housing includes a base wall that defines openings therethrough. The signal contacts project through at least some of the openings beyond a top side of the base wall. The signal contacts are arranged in pairs. The ground shields project through at least some of the openings beyond the top side of the base wall. Each ground shield has at least two walls that are connected to one another along edges thereof. Each ground shield at least partially surrounds a corresponding pair of the signal contacts. Each ground shield has an inner side that faces the corresponding pair of signal contacts and an outer side that is opposite the inner side. The outer sides of the ground shields have a lossy coating to absorb electrical resonances and the inner sides of the ground shields lack the lossy coating.

In one or more embodiments, an electrical connector is provided that includes a housing, signal contacts, and ground shields. The housing includes a base wall. The signal contacts are arranged in pairs and held by the housing. The signal contacts project beyond a top side of the base wall into a mating zone. The ground shields are held by the housing and project beyond the top side of the base wall into the mating zone. Each ground shield has a metal body that includes at least two walls connected to one another along edges thereof. Each ground shield surrounds and electrically shields a corresponding pair of the signal contacts on at least two sides thereof. Each of the ground shields has an inner side that faces the corresponding pair of signal contacts and an outer side that is opposite the inner side. The outer sides of the ground shields have a lossy coating on the metal body along at least a majority of the surface area of the outer side to absorb electrical resonances. The inner sides of the ground shields lack the lossy coating.

In one or more embodiments, an electrical connector is provided that includes a housing, signal contacts, and ground shields. The housing includes a base wall. The signal contacts are arranged in pairs and held by the housing. The signal contacts project beyond a top side of the base wall into a mating zone. The ground shields are held by the housing and project beyond the top side of the base wall into the mating zone. Each ground shield has a metal body that includes a center wall, a first side wall, and a second side wall. The first side wall is connected to a first edge of the center wall. The second side wall is connected to a second edge of the center wall that is opposite the first edge. The first and second side walls generally extend parallel to one another in a common direction from the center wall. Each ground shield surrounds and electrically shields a corresponding pair of the signal contacts on at least three sides. Each of the ground shields has an inner side that faces the corresponding pair of signal contacts and an outer side that is opposite the inner side. The outer sides of the ground shields have a lossy coating on the metal body along an entirety of the surface area of the outer side to absorb electrical resonances. The inner sides of the ground shields lack the lossy coating.

DETAILED DESCRIPTION OF THE INVENTION

Figure 1:
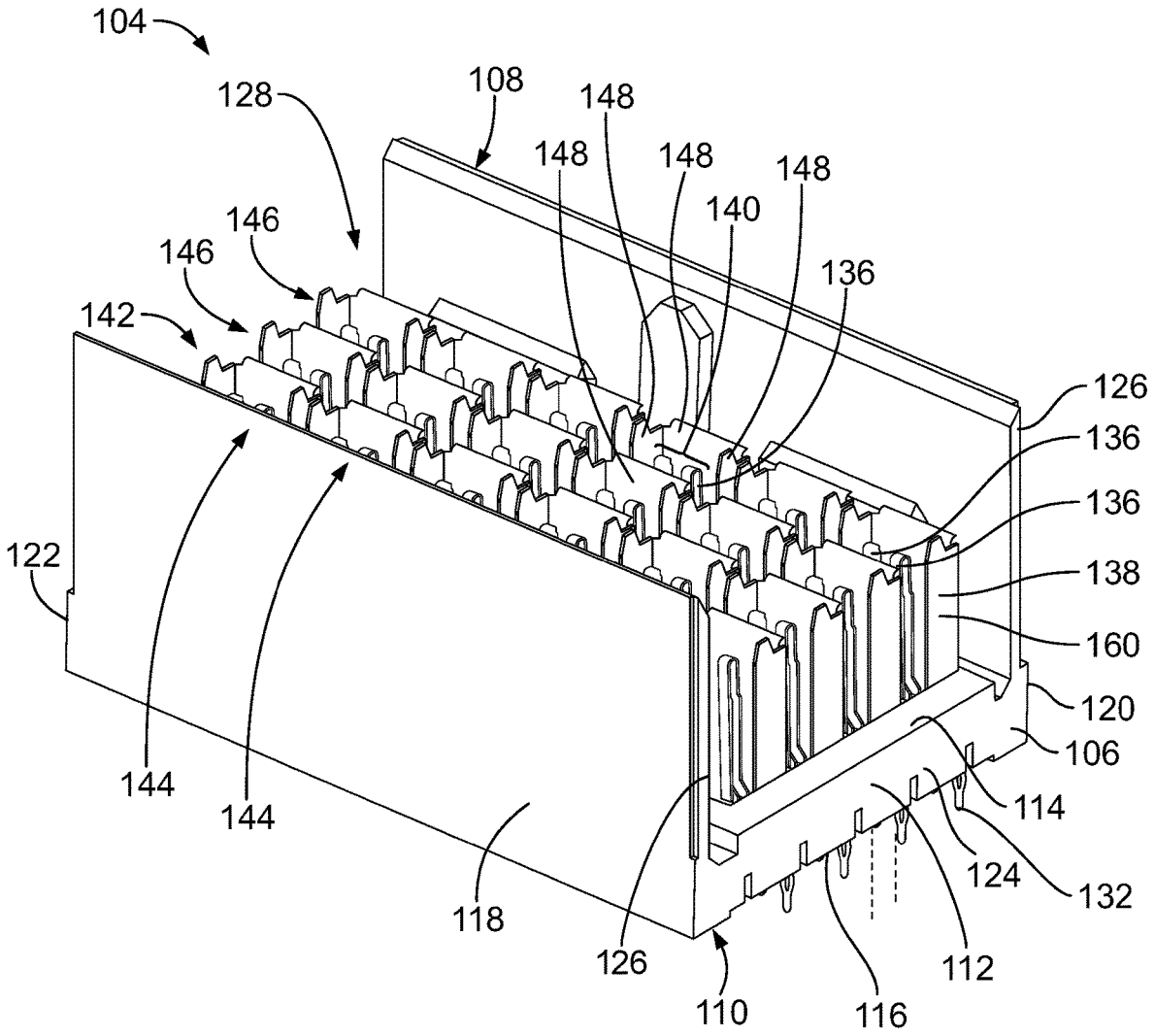
FIG. 1 is a perspective view of an electrical connector according to an embodiment.

FIG. 1 is a perspective view of an electrical connector 104 according to an embodiment. The electrical connector 104 includes a housing 106, signal contacts 136, and ground shields 138. The housing 106 of the electrical connector 104 extends between a mating end 108 and a mounting end 110. The mounting end 110 is configured to be mounted to a host circuit board. The mating end 108 interfaces with a mating electrical connector (referred to herein as mating connector) when the mating connector is selectively coupled to the electrical connector 104. When connected to the mating connector, the electrical connector 104 provides electrically conductive signal pathways between the circuit board and the mating connector. The electrical connector 104 may be a high speed connector that transmits data signals at speeds over 10 gigabits per second (Gbps), such as over 25 Gbps or over 35 Gbps. The electrical connector 104 may also be configured to transmit low speed data signals and/or power.

The housing 106 includes a base wall 112. The base wall 112 has a top side 114 and a bottom side 116 that is opposite the top side 114. As used herein, relative or spatial terms, such as "top," "bottom," "front," "rear," "upper," and "lower," are only used to identify and distinguish the referenced elements in the illustrated orientations and do not necessarily require particular positions or orientations relative to gravity or relative to the surrounding environment of the electrical connector 104. The bottom side 116 faces the circuit board and may define the mounting end 110. The base wall 112 of the housing 106 holds the signal contacts 136 and the ground shields 138. The signal contacts 136 and the ground shields 138 extend through the base wall 112 and project beyond the top side 114 into a mating zone for electrically connecting to corresponding conductive elements of the mating connector. In the illustrated embodiment, the signal contacts 136 and the ground shields 138 have respective terminating ends 132 that protrude beyond the bottom side 116 of the base wall 112 for mechanically and electrically connecting to the circuit board. The terminating ends 132 are compliant pins, such as eye-of-the-needle pins, that are configured to be through-hole mounted to the circuit board. For example, the compliant pin may be received in corresponding vias or through-holes of the circuit board. In another embodiment, the terminating ends 132 may be solder tails or pads configured to be surface-mounted to the circuit board. The terminating ends 132 of the signal contacts 136 physically engage and electrically connect to conductive signal pathways in the circuit board, such as traces, and the terminating ends 132 of the ground shields 138 physically engage and electrically connect to conductive grounding elements in the circuit board.

The housing 106 extends a width between a first side 118 and a second side 120 that is opposite the first side 118. The housing 106 extends a length between a first end 122 and a second end 124 that is opposite the first end 122. In the illustrated embodiment, the housing includes shroud walls 126 that extend from the top side 114 of the base wall 112 along the sides 118, 120. Distal ends of the shroud walls 126 define the mating end 108 of the housing 106. The housing 106 defines a cavity 128 into which the mating connector is received during a mating operation. The cavity 128 is defined between the shroud walls 126. The cavity 128 extends a depth from the distal ends of the shroud walls 126 (at the mating end 108) to the top side 114 of the base wall 112. The signal contacts 136 and the ground shields 138 are disposed between the two shroud walls 126. Lengths of the signal contacts 136 and the ground shields 138 are exposed within the cavity 128 for connecting to corresponding mating conductors of the mating connector. Optionally, the housing 106 may include additional shroud walls that extend along the ends 122, 124 to fully enclose a perimeter of the cavity 128. The cavity 128 is open at the mating end 108 to receive the corresponding mating connector through the open mating end 108. In the illustrated embodiment, the electrical connector 104 may be configured to receive a board-mounted mating connector. The shroud walls 126 may guide the mating connector into the cavity 128 through the mating end 108 to engage the signal contacts 136 and the ground shields 138.

The signal contacts 136 and the ground shields 138 are arranged side by side in an array 142 that includes multiple columns 144 and multiple rows 146. The columns 144 are oriented perpendicular to the rows 146. Each of the columns 144 extends from the first side 118 to the second side 120. Each of the rows 146 extends from the first end 122 to the second end 124.

The signal contacts 136 are electrically conductive, and may be composed of an electrically conductive metal material, such as copper, silver, nickel, gold, and/or alloys thereof. In a non-limiting example, the signal contacts 136 may have a copper base and at least a portion of the contacts 136 may be plated with tin, silver, gold, and/or the like, such as along surfaces that physically engage mating contacts of the mating connector. In the illustrated embodiment, the signal contacts 136 are arranged in pairs 140. The pairs 140 of signal contacts 136 may be utilized to transmit differential signals at high frequencies (e.g., greater than 20 GHz) and fast signal speeds.

Each of the ground shields 138 is configured to provide shielding for at least a corresponding pair 140 of signal contacts 136 in the array 142. For example, each ground shield 138 may surround a different corresponding pair 140 of signal contacts 136 on at least two sides thereof. The ground shields 138 each have at least two walls 148 that are connected to one another along edges thereof. The walls 148 extend along different sides of the pair 140 to surround the pair 140 on at least two sides. The ground shields 138 are electrically conductive to provide electrical shielding for the signal contacts 136. For example, each of the ground shields 138 may have a metal body 160 that is composed of one or more metal materials, such as copper, tin, nickel, and/or the like, including alloys thereof. The walls 148 are defined by the metal body 160. The ground shields 138 provide electrical shielding to reduce electrical crosstalk and other electromagnetic interference between pairs 140 of signal contacts 136. Additional sides of the corresponding pair 140 may be shielded by other ground shields 138 in the array 142.

Figure 2:
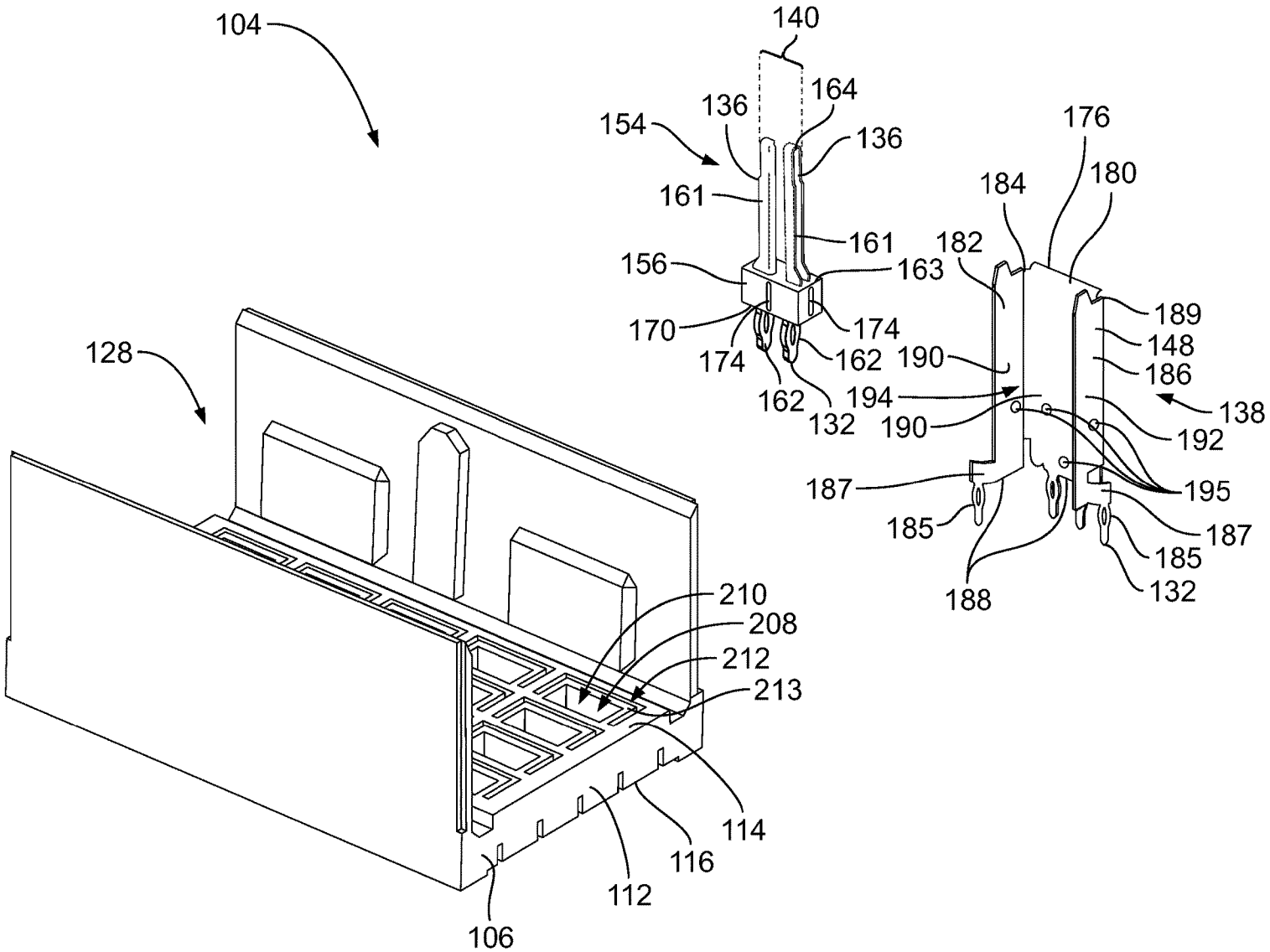
FIG. 2 is an exploded perspective view of the electrical connector according to an embodiment.

FIG. 2 is an exploded perspective view of the electrical connector 104 according to an embodiment. In the illustrated embodiment, the pairs 140 of signal contacts 136 are held by individual dielectric bodies 156 to define signal pods 154. Only one signal pod 154 and one ground shield 138 are shown in FIG. 2. The illustrated signal pod 154 and ground shield 138 may represent the shapes and features of the other respective signal pods 154 and ground shields 138, respectively.

The base wall 112 of the housing 106 defines openings 208 that extend through the base wall 112 from the top side 114 to the bottom side 116 thereof. The signal contacts 136 are held in at least some of the openings 208. The ground shields 138 are held in at least some of the openings 208. In the illustrated embodiment, the ground shields 138 are held in different openings than the signal contacts 136. For example, the base wall 112 defines signal apertures 210 and ground slots 212 that together represent the openings 208. Each signal aperture 210 is sized and shaped to receive a single signal pod 154 therein. Each ground slot 212 is sized and shaped to receive a single ground shield 138 therein. The signal apertures 210 are discrete from the ground slots 212 and are spaced apart by intervening portions 213 of the base wall 112. In an alternative embodiment, the signal contacts 136 and the ground shields 138 are received in common openings 208 of the base wall 112. For example, each opening 208 may be sized and shaped to receive one signal pod 154 and the ground shield 138 that at least partially surrounds the signal contacts 136 in the signal pod 154.

In an embodiment, the housing 106 is composed of a low loss dielectric material, such as one or more plastics. For example, the base wall 112 may be composed of a dielectric material to provide electrical insulation between the pairs 140 of signal contacts 136 and ground shields 138 in the array 142. But, in an alternative embodiment, the housing 106 may be fully or at least partially electrically conductive. For example, in such alternative embodiment the base wall 112 may be composed of one or more metals. The electrically conductive base wall 112 engages the ground shields 138 to electrically common the ground shields 138 with one another. The signal contacts 136 are electrically insulated from the electrically conductive base wall 112 via the dielectric body 156 to avoid short circuits. Electrically commoning the ground shields 138 with one another via the base wall 112 may provide enhanced shielding effectiveness and signal performance (relative to known connectors that do not have electrically conductive base walls).

The dielectric body 156 holds the signal contacts 136 in fixed positions such that the two signal contacts 136 are spaced apart from one another to avoid direct physical engagement between the signal contacts 136 in the same pair 140. The signal contacts 136 are held to extend generally parallel to each other. The signal contacts 136 each have a mating segment 161, a tail 162, and an intermediate segment (not shown) between the mating segment 161 and the tail 162. The dielectric body 156 is composed of a dielectric material, such as one or more plastics. The dielectric body 156 surrounds and encases the intermediate segments of the signal contacts 136. The dielectric body 156 optionally may be overmolded (e.g., formed in situ) on the signal contacts 136. The dielectric body 156 optionally includes one or more crush ribs 174. The crush ribs 174 are configured to provide an interference fit with the base wall 112 of the housing 106 when the signal pod 154 is loaded in the base wall 112.

The mating segment 161 of each signal contact 136 extends from a front end 163 of the dielectric body 156 to a distal end 164 of the signal contact 136. The mating segment 161 is the portion of the signal contact 136 that extends into the cavity 128 (shown in FIG. 1) beyond the top side 114 of the base wall 112. The mating segment 161 is configured to engage a corresponding mating signal contact of the mating connector. The mating segment 161 in the illustrated embodiment is a pin, but may have another shape in an alternative embodiment, such as a blade, a spring beam, a socket, or the like. The tails 162 protrude from a rear end 170 of the dielectric body 156 to the terminating end 132 of the respective signal contacts 136. In the illustrated embodiment, the tails 162 are compliant pins, as described above with reference to FIG. 1.

The ground shield 138 in the illustrated embodiment has three walls 148 including a center wall 180, a first side wall 182, and a second side wall 186. The first side wall 182 is connected to and extends from a first edge 184 of the center wall 180. The second side wall 186 is connected to and extends from a second edge 189 of the center wall 180. The second edge 189 is opposite the first edge 184. The center wall 180 and the first and second side walls 182, 186 may be generally planar. The first side wall 182 may extend generally parallel to the second side wall 186 in a common direction from the center wall 180. Thus, the ground shield 138 has a C-shaped (or U-shaped) cross-section taken along a transverse plane that intersects all three walls 180, 182, 186. Optionally, the side walls 182, 186 may be oriented at approximately right angles relative to the center wall 180 (e.g., such as within plus/minus 5 degrees of a 90 degree angle).

The ground shield 138 optionally may be stamped and formed from a sheet of metal. For example, the center wall 180 may be formed integral to the side walls 182, 186, and the side walls 182, 186 are bent out of plane from the center wall 180 to define the side walls 182, 186.

The ground shield 138 may include compliant pins 185 extending from a bottom edge 188 of at least some of the walls 180, 182, 186 to the terminating end 132. The compliant pins 185 are configured to be through-hole mounted to the circuit board to provide an electrical grounding path between the ground shield 138 and the circuit board, as described above with reference to FIG. 1. In an alternative embodiment, instead of compliant pins 185, the ground shield 138 may have solder tails or pads configured to be surface-mounted to the circuit board. In the illustrated embodiment, the center wall 180 and the side walls 182, 186 extend from the bottom edges 188 to a mating end 176 of the ground shield 138. The mating end 176 represents a distal end of the ground shield 138 that is the farthest part of the ground shield 138 from the base wall 112 when loaded in the housing 106. In an alternative embodiment, the ground shield 138 may include one or more projections, such as contact beams, extending from the center wall 180 and/or side walls 182, 186, and the contact beams define the mating end 176 of the ground shield 138.

In the illustrated embodiment, the ground shield 138 includes a tab 187 extending from each of the first and second side walls 182, 186 at or proximate to the bottom edge 188. One compliant pin 185 extends from each of the two tabs 187. The tabs 187 may be used to match the footprint of the ground shield 138 to a designated arrangement of vias or through-holes in the circuit board. The tabs 187 may also be used to secure the ground shield 138 to the base wall 112. For example, the tabs 187 may be received within grooves of the base wall 112 that extend from the respective ground slot 212 in which the ground shield 138 is received.

The ground shield 138 has an inner side 190 and an outer side 192 that is opposite the inner side 190. The inner side 190 and the outer side 192 are defined by corresponding surfaces of the center wall 180, the first side wall 182, and the second side wall 186. Due to the C-shape cross-section, the inner side 190 of the ground shield 138 defines a channel 194 or recess. The channel 194 is configured to accommodate a corresponding signal pod 154 therein, without necessarily directly physically contacting the signal pod 154. The inner side 190 of the ground shield 138 faces towards the pair 140 of signal contacts 136 of the signal pod 154 within the channel 194. The outer side 192 of the ground shield 138 faces away from that corresponding pair 140 of signal contacts 136. In the illustrated embodiment, when the signal pod 154 is loaded into the signal aperture 210 and the ground shield 138 is loaded into the corresponding ground slot 212, the C-shaped ground shield 138 surrounds the pair 140 of signal contacts 136 on three sides. For example, the first side wall 182 surrounds the pair 140 on one side, the center wall 180 surrounds the pair 140 on a second side, and the second side wall 186 surrounds the pair 140 on a third side. Thus, the C-shaped ground shields 138 provide electrical shielding for the corresponding pair 140 of signal contacts 136 on three sides thereof to electrically shield the two signal contacts 136 from other signal contacts 136 in the array 142. The center wall 180 of an adjacent C-shaped ground shield 138 in the same column 144 (shown in FIG. 1) may shield the pair 140 of signal contacts 136 along a fourth side.

The ground shield 138 may have one or more dimples 195 that protrude from the ground shield 138 along the inner side 190 and/or the outer side 192. The dimples 195 may be bumps, bulges, tabs, ribs, or the like that extend out from the plane of the respective wall of the ground shield 138. In the illustrated embodiment, there are dimples 195 along both the inner side 190 and the outer side 192. The dimples 195 are located along the center wall 180 and along the two side walls 182, 186. The dimples 195 are disposed proximate to the bottom edges 188 of the walls 180, 182, 186. The dimples 195 align with the base wall 112 when the ground shield 138 is loaded into the ground slot 212, and engage interior surfaces of the base wall 112 within the ground slot 212 to provide an interference fit for the ground shield 138 within the ground slot 212. In the particular embodiment in which the base wall 112 is electrically conductive, the physical contact between the dimples 195 and the interior surfaces of the base wall 112 may provide electrical connection points for electrically communing the ground shields 138 through the base wall 112. Thus, the dimples 195 may electrically connect the ground shield 138 to the base wall 112 in addition to physically engaging and securing the ground shield 138 to the base wall 112.

Figure 3:
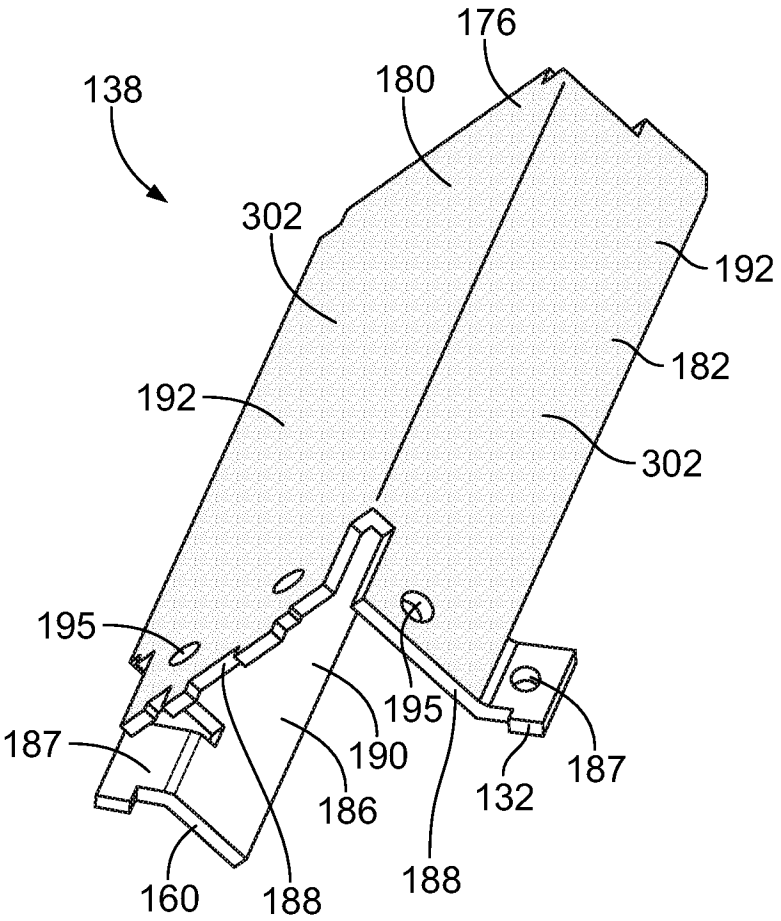
FIG. 3 is an isolated perspective view of one ground shield of the electrical connector according to an embodiment.

FIG. 3 is an isolated perspective view of one of the ground shields 138 of the electrical connector 104 according to an embodiment. The ground shield 138 is the same as the ground shield 138 shown in FIG. 2 except that the ground shield 138 in FIG. 3 lacks compliant pins at the terminating end 132. In another embodiment, the ground shield 138 may include compliant pins, as shown in FIG. 2. The illustrated ground shield 138 may represent the shapes and features of the other respective ground shields 138 in the array 142 (shown in FIG. 1).

In one or more embodiments, the ground shield 138 has a lossy coating 302 that is configured to absorb electrical resonances that propagate along the conductors (e.g., signal contacts 136 and ground shields 138), especially at high signal speeds and transmission frequencies. The lossy coating 302 is applied on the metal body 160 of the ground shield 138 on the outer side 192 thereof, which is the side facing away from the corresponding pair 140 of signal contacts 136 that is shielded by the ground shield 138.

The lossy coatings 302 are configured to reduce and dissipate electrical resonances that reflect back and forth along the lengths of the ground shields 138. For example, without a lossy coating 302, resonating electrical energy along the ground shields 138 may form a standing wave that interferes with the signal transmission through the receptacle connector 104. The amount of interference may be greater with high speed connectors, such as the receptacle connector 104, relative to lower speed connectors. The lossy coatings 302 on the ground shields 138 dissipate at least some of the electrical energy that resonates along the ground shields 138 to reduce unfavorable ground resonances within certain frequency bands of interest. For example, the lossy coatings 302 may dissipate electrical resonances above 8 GHz.

The lossy coating 302 is composed of a lossy material, which has a greater loss tangent than the low loss dielectric material of the dielectric body 156 of the signal pod 154. The lossy material of the coating 302 also has a greater loss tangent than the low loss dielectric material of the housing 106 (in the embodiments in which the housing 106 is composed of a dielectric material). As a consequence, the lossy coating 302 more readily absorbs and dissipates electrical energy (e.g., current) than the dielectric body 156 and the dielectric material of the housing 106. Alternatively, or in addition, the lossy coating 302 may be at least partially conductive. The lossy material may have a higher resistivity than the metal body 160 of the ground shield 138 and the metal material of the signal contacts 136, such that the conductivity of the lossy material is less than the metal body 160 and the signal contacts 136.

The lossy material of the lossy coating 302 may include electrically conductive filler particles dispersed within a dielectric binder. The dielectric binder is used to hold the conductive filler particles in place and at least partially control the electrical properties (e.g., conductivity) of the lossy material. As used herein, the term "binder" encompasses material that encapsulates the filler or is impregnated with the filler. The binder may be any material that will set, cure, or can otherwise be used to position the filler material. In one or more embodiments, the binder is a curable thermosetting polymer, such as an epoxy, an acrylic resin, or the like.

The conductive filler particles impart loss to the lossy material. Examples of conductive particles that may be used as a filler to form electrically lossy materials include carbon or graphite formed as fibers, flakes, powders, or other particles. Metal in the form of powder, flakes, fibers, or other conductive particles may also be used as the conductive filler elements to provide suitable lossy properties. Alternatively, combinations of fillers may be used. For example, metal plated (or coated) particles may be used. Silver and nickel may also be used to plate particles. Plated (or coated) particles may be used alone or in combination with other fillers, such as carbon flakes. In some embodiments, the fillers may be present in a sufficient volume percentage to allow conducting paths to be created from particle to particle. For example, when metal fiber is used, the fiber may be present at an amount up to 40% or more by volume.

In an embodiment, the lossy coating 302 may be composed of a high resistivity (e.g., low conductivity) conductive material that includes carbon. For example, the lossy coating 302 may include carbon particles (e.g., carbon black). The resistivity of the lossy coating 302 may be greater than 15 Ohms/sq., such as between 20 Ohms/sq. and 35 Ohms/sq. In a non-limiting example, the lossy coating 302 may be or include DuPont™ 7102 Carbon, DuPont™ 7082 Carbon, DuPont™ 5028 Silver, and/or DuPont™ 3571 Dielectric materials.

In some embodiments, the lossy material of the lossy coating 302 may simultaneously be electrically-lossy and a magnetically-lossy. For example, the lossy material may be composed of a binder material with magnetic particles dispersed therein to provide magnetic properties. Materials such as magnesium ferrite, nickel ferrite, lithium ferrite, yttrium garnet and/or aluminum garnet may be used as magnetic particles. The magnetic particles may be in the form of flakes, fibers, or the like. Such lossy materials may be formed, for example, by using magnetically-lossy filler particles that are partially conductive or by using a combination of magnetically-lossy and electrically-lossy filler particles.

The lossy coating 302 may be formed on the metal body 160 along the outer side 192 of the ground shield 138 via various application methods, such as dipping, spraying, molding, painting, printing, plating, chemical vapor deposition, or the like. For example, the lossy coating 302 is applied in a two-step process that includes dipping the outer side 192 of the ground shield 138 in the lossy material while the lossy material is in a flowable, fluid state and subsequently thermally annealing the ground shield 138 to cure the lossy material. In another embodiment, the lossy material may be painted, sprayed, or otherwise applied (such as electrostatically or magnetically) to the metal body 160 without dipping the metal body 160 into the lossy material. In a non-limiting example, the lossy coating 302 may be fabricated via a printing process, such as screen printing, pad printing, dispense printing, or the like.

Various characteristics of the lossy coating 302, such as the concentration of conductive filler material, the thickness of the coating 302, the surface area of the coating 302 on the metal body 160, the location(s) of the coating 302 on the metal body 160, and the like, may be controlled to tune the electrical absorption properties of the lossy coating 302 for the particular electrical connector 104 and the desired utilization of the connector 104. For example, the characteristics of the lossy coating 302 may be selected to provide a desired amount of electrical energy absorption and dissipation, while also limiting signal degradation attributable to insertion loss caused by the lossy coating 302. The characteristics may be selected such that the lossy coatings 302 of the ground shields 138 absorb electrical resonances at high frequencies, such as (but not limited to) frequencies above 20 GHz. In one or more embodiments, the lossy coating 302 may have a thickness of less than about 0.5 mm, such as less than about 0.4 mm, less than about 0.2 mm, or less than about 0.1 mm.

In one or more embodiments, the lossy coating 302 is disposed on the outer side 192 of the ground shield 138, and the inner side 190 of the ground shield 138 lacks the lossy coating 302. Thus, the inner side 190 of the metal body 160 is not coated by the lossy material. The lossy coating 302 is applied to the metal body 160 along the outer side 192, but is not applied to the metal body 160 along the inner side 190. Only coating the outer sides 192 of the ground shields 138 with the lossy coating 302 may provide electrical benefits, such as mitigation of electrical resonances without interfering with signal transmission (e.g., without causing or significantly increasing insertion loss relative to not having the lossy coating 302 on the ground shields 138). During operation of the electrical connector 104, a greater proportion (e.g., most) of the return current propagates along the inner sides 190 of the ground shields 138 than along the outer side 192 due to a proximity effect. The return current propagates along the inner sides 190 because the inner sides 190 are located closer to the signal contacts 136 than the outer sides 192. Inversely, a greater proportion (e.g., most) of electrical resonances may propagate along the outer sides 192 than along the inner sides 190. Applying the lossy coating 302 along the outer sides 192 mitigates the resonating currents that propagate back and forth along the outer sides 192 with negligible effects, if any, on signal transmission performance and signal integrity. For example, the lossy coating 302 is spaced apart and shielded from the signal contacts 136 by the metal bodies 160 of the ground shields 138, and does not significantly affect the return current propagating along the inner sides 190 of the ground shields 138. Furthermore, the inner sides 190 of the ground shields 138 may physically engage and electrically connect to mating ground contacts of the mating connector, so the exposed metal bodies 160 along the inner sides 190 may provide low resistance connection points with the mating ground contacts.

In the embodiment shown in FIG. 3, the lossy coating 302 covers a majority (e.g., at least 50%) of the surface area of the outer side 192 of the ground shield 138. For example, the lossy coating 302 (illustrated by a pattern in FIG. 3) is disposed on each of the center wall 180, the first side wall 182, and the second side wall 186. On each wall 180, 182, 186, the lossy coating 302 covers an entirety of the surface area along the outer side 192 spanning from the bottom edge 188 to the mating end 176. In the illustrated embodiment, the entire surface area of the outer side 192 of the ground shield 138 is covered in the lossy coating 302 except for the tabs 187 and the dimples 195. The metal body 160 along the tabs 187 and the dimples 195 is exposed to the surrounding environment (e.g., not covered in the lossy coating 302). For example, the dimples 195 protrude beyond the thickness of the lossy coating 302 on the respective walls 180, 182, 186. The dimples 195 and/or the tabs 187 may be exposed along the outer side 192 to provide an electrical connection to the base wall 112 (shown in FIG. 2). For example, in the embodiment in which the base wall 112 is electrically conductive, leaving the dimples 195 and/or the tabs 187 uncovered by the lossy coating 302 may enable a lower resistance electrical connection between the ground shields 138 and the base wall 112 relative to coating the dimples 195 and the tabs 187 with the lossy coating 302. Although not shown in FIG. 3, the compliant pins 185 of the ground shields 138 that extend from the bottom edges 188 for electrically connecting to the circuit board may also lack the lossy coating 302.

In one alternative embodiment, the entire outer side 192 of the ground shield 138 is covered in the lossy coating 302, such that an entirety of the surface area of the outer side 192 is coated including the dimples 195 and the tabs 187. For example, in the embodiment in which the base wall 112 is non-conductive and composed of a dielectric material, the dimples 195 and the tabs 187 are used for establishing mechanical connections, not electrical connections, with the base wall 112, so the electrical resistance at the connection points may be inconsequential. In other embodiments, the lossy coating 302 may cover less than an entirety of each of the three walls 180, 182, 186 between the bottom edges 188 and the mating end 176. For example, the lossy coating 302 may cover the outer side 192 of the walls 180, 182, 186 along the portion that projects beyond the top side 114 of the base wall 112, and may not be applied on the outer side 192 in the portion that aligns with the base wall 112 (and is disposed within the ground slot 212 thereof when assembled). As described above, the extent of surface area of the outer side 192 of the ground shield 138 that is covered by the lossy coating 302, the locations of the lossy coating 302, the thickness of the lossy coating 302, and the composition of the lossy coating 302 may be customized to tune for specific uses and particular circumstances to provide desired connector performance properties.

Figure 4:
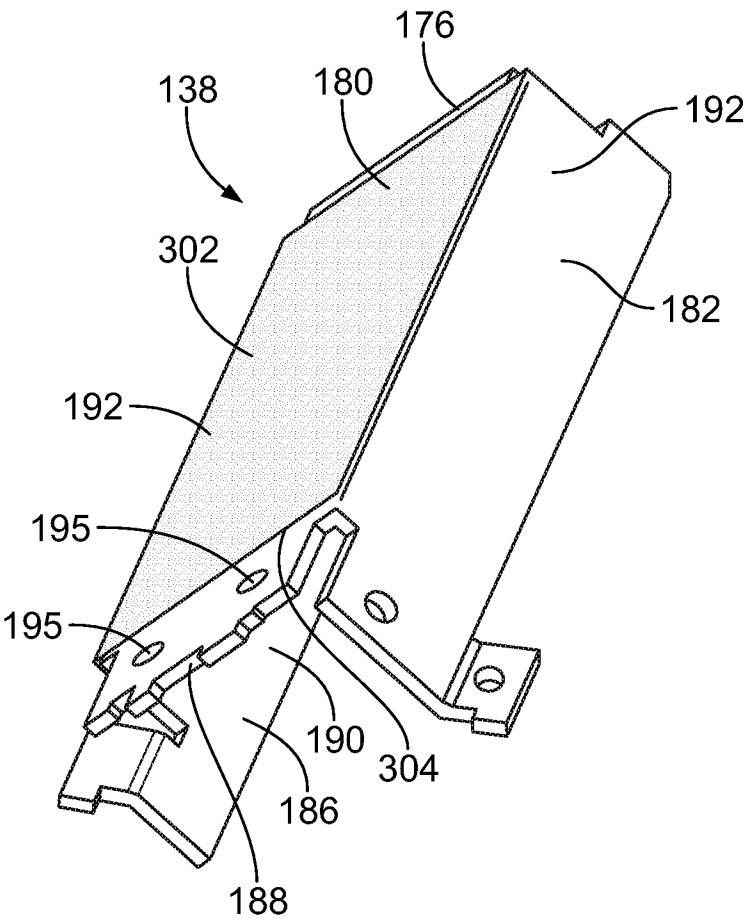
FIG. 4 is an isolated perspective view of one ground shield of the electrical connector according to another embodiment.

FIG. 4 is an isolated perspective view of one of the ground shields 138 of the electrical connector 104 according to another embodiment. In the illustrated embodiment, the lossy coating 302 is applied on the outer side 192 of the ground shield 138 along the center wall 180. Unlike the embodiment shown in FIG. 3, the first and second side walls 182, 186 lack the lossy coating 302, even along the outer side 192. In addition, the lossy coating 302 on the center wall 180 covers a majority of the surface area of the center wall 180 without covering an entirety of the surface area of the center wall 180. For example, the lossy coating 302 extends from the mating end 176 to an edge 304 that is between the dimples 195 and the mating end 176. The edge 304 of the lossy coating 302 is proximate to the dimples 195, but is spaced apart from the bottom edge 188 of the center wall 180. For example, the portion of the center wall 180 proximate to the bottom edge 188 that aligns with the base wall 112 when loaded in the ground slot 212 may lack the lossy coating 302, while the portion of the center wall 180 that projects beyond the top side 114 of the base wall 112 into the mating zone may be covered by the lossy coating 302. In the illustrated embodiment, the inner side 190 of the ground shield 138 lacks the lossy coating 302, similar to the embodiment shown in FIG. 3.

In an alternative embodiment, the lossy coating 302 may be applied along at least a portion of the inner sides 190 of the ground shields 138. For example, the lossy coating 302 may cover a minority (e.g., less than 50%) of the surface area of the inner side 190 and/or may have a reduced thickness relative to the thickness of the lossy coating 302 along the outer side 192. The ground shields 138 may have more lossy coating 302 by weight on the outer sides 192 than the inner sides 190 to mitigate electrical resonances with limited, in any, interference with signal transmission through the electrical connector 104.

Figure 5:
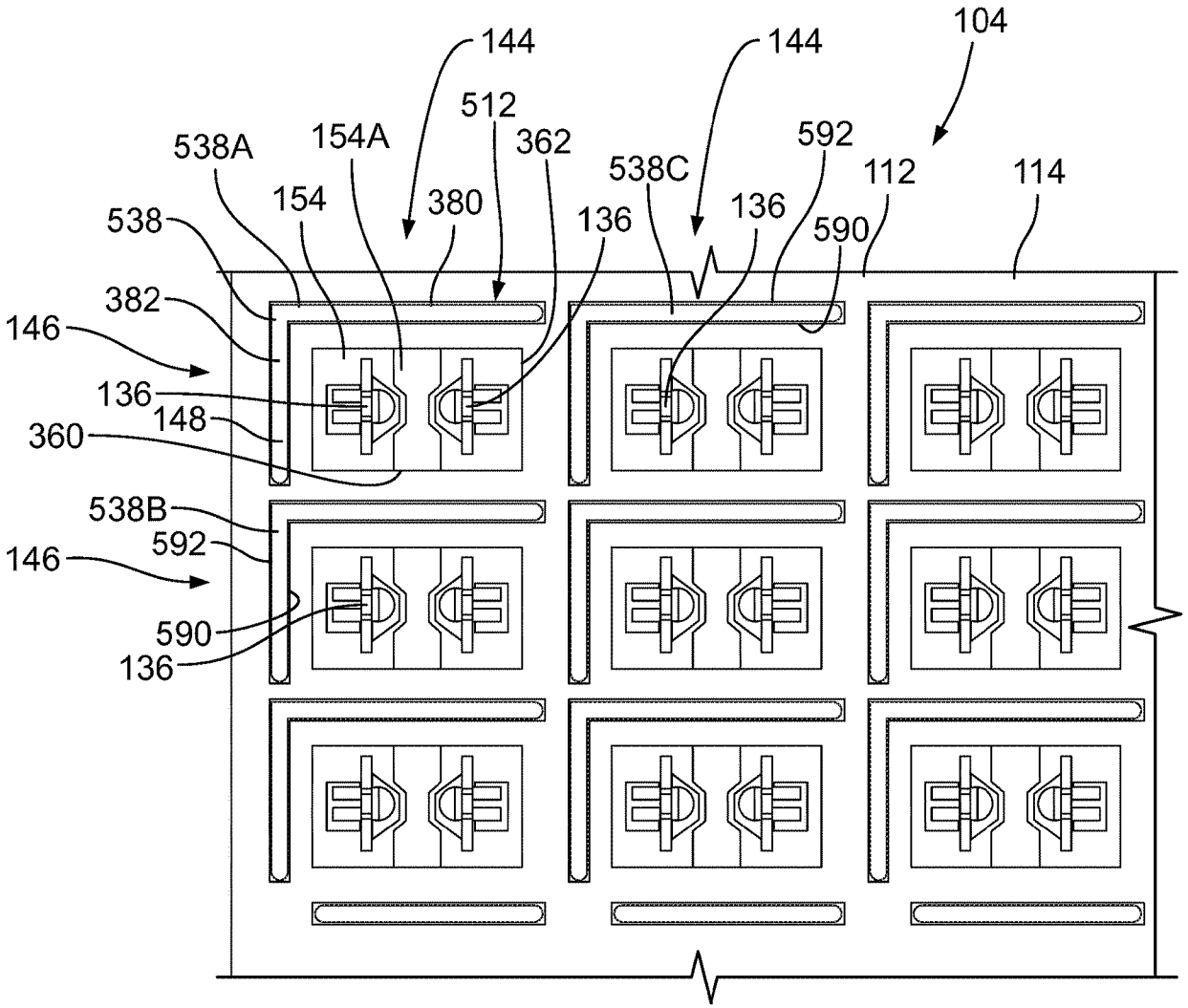
FIG. 5 illustrates a portion of the electrical connector showing a top side of a base wall, signal contacts, and ground shields thereof according to an alternative embodiment.

FIG. 5 illustrates a portion of the electrical connector 104 showing the top side 114 of the base wall 112, signal contacts 136, and ground shields 538 thereof according to an alternative embodiment. In the illustrated embodiment, the electrical connector 104 has different ground shields 538 than the connector 104 in FIGS. 1 through 4. Each of the ground shields 538 has two walls 148, and the two walls 148 of each ground shield 538 are connected to each other along an edge. The ground shields 538 are L-shaped instead of the C-shaped shields 138 shown in FIGS. 1 through 4. For example, the two walls 148 include a center wall 380 and one side wall 382 extending from the center wall 380. The walls 380, 382 are planar, but may be curved in another embodiment. The ground shields 538 may have the same or similar material compositions as the ground shields 138. For example, the L-shaped ground shields 538 are covered with a lossy coating along an outer side 592 of at least a portion of one or both walls 148 of the shields 538, and may lack the lossy coating along the inner sides 590 of the ground shields 538. For example, the lossy coating may cover only a portion of the outer side 592 of one of the two walls 148, only a portion of the outer side 592 of both walls 148, an entirety of the outer side 592 of one of the two walls 148, and/or an entirety of the outer side 592 of both walls 148.

The ground shields 538 are held in L-shaped ground slots 512 that accommodate the ground shields 538. Each ground shield 538 surrounds an associated signal pod 154 on two sides thereof to provide electrical shielding for the signal contacts 136 in the signal pod 154 from other signal contacts 136. For example, a first ground shield 538A surrounds a first signal pod 154A on two sides. A second ground shield 538B adjacent to the first ground shield 138A in the same column 144 provides shielding for the first signal pod 154A along an open, third side 360 of the first signal pod 154A. A third ground shield 138C adjacent to the first ground shield 138A in the same row 146 provides shielding for the first signal pod 154A along an open, fourth side 362 of the first signal pod 154A such that the first signal pod 154A is shielded on all four sides. The connector 104 may include orphan shields (not shown) along edges of the base wall 112 to ensure that all of the signal contacts 136 are shielded on four sides.

The above described embodiments provide an electrical connector that includes a lossy coating along outer sides of the ground shields. The lossy coating absorbs and dissipates at least some electrical energy (e.g., current) that resonates along the current path defined by the conductors to provide low electrical conductivity and/or magnetic lossiness. The lossy coating may absorb and dissipate resonances in a certain, targeted frequency range. Electrical performance of the electrical connector is enhanced by the inclusion of the lossy coating along the outer sides of the ground shields. For example, the low electrical conductivity lossy coating of the ground shields may attenuate surface current and reduce crosstalk and other electromagnetic interference (e.g., noise). The lossy coating may be applied (only) on the outer sides of the ground shields that face away from the signal contacts, so the lossy coating is on the opposite side of the ground shield from the inner side along which most of the return current is conveyed.

Although the ground shields described herein are C-shaped and L-shaped, the electrical connector according to other embodiments may have ground shields with other shapes, such as (single-walled) planar blades or the like. It is understood that such other ground shields may have lossy coatings as described herein. For example, a planar blade ground shield may be coated with a lossy material along an outer side thereof that does not face toward signal contacts that are shielded by the planar blade ground shield.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a housing including a base wall that defines openings therethrough;

signal contacts projecting through at least some of the openings beyond a top side of the base wall, the signal contacts arranged in pairs; and ground shields projecting through at least some of the openings beyond the top side of the base wall, each ground shield having at least two walls that are connected to one another along edges thereof, each ground shield at least partially surrounding a corresponding pair of the signal contacts, wherein each ground shield has an inner side that faces the corresponding pair of signal contacts and an outer side that is opposite the inner side, wherein the outer sides of the ground shields have a lossy coating to absorb electrical resonances and the inner sides of the ground shields lack the lossy coating.

2. The electrical connector of claim 1, wherein the lossy coating covers a majority of the surface area of the outer side of each of the ground shields.

3. The electrical connector of claim 1, wherein the lossy coating covers an entirety of the surface area of the outer side of each of the ground shields.

4. The electrical connector of claim 1, wherein each of the ground shields has a metal body that defines the at least two walls, wherein the lossy coating on the outer side of the metal body has a higher resistivity than the metal body.

5. The electrical connector of claim 1, wherein the at least two walls of the ground shields includes a center wall, a first side wall, and a second side wall, the first side wall connected to a first edge of the center wall, the second side wall connected to a second edge of the center wall, the first and second side walls generally extending parallel to one another in a common direction from the center wall such that the ground shields surround the corresponding pair of signal contacts on at least three sides.

6. The electrical connector of claim 5, wherein the lossy coating is disposed on the outer side of each of the ground contacts along at least the center wall.

7. The electrical connector of claim 1, wherein the base wall of the housing is electrically conductive, and the ground shields include dimples along the outer side that protrude outward, the dimples configured to physically engage and electrically connect to the base wall within the openings of the base wall, wherein the dimples along the outer side of the ground shields lack the lossy coating.

8. The electrical connector of claim 1, wherein the lossy coating includes carbon particles therein.

9. The electrical connector of claim 1, wherein the signal contacts and the ground shields are arranged in an array of rows and columns, wherein the columns extend perpendicular to the rows.

10. The electrical connector of claim 1, wherein the lossy coating includes electrically conductive filler particles dispersed within a dielectric binder.

11. The electrical connector of claim 1, wherein the base wall of the housing is composed of a dielectric material, the lossy coating of the ground shields having a loss tangent that is greater than a loss tangent of the dielectric material of the base wall.

12. An electrical connector comprising:

a housing including a base wall;

signal contacts arranged in pairs and held by the housing, the signal contacts projecting beyond a top side of the base wall into a mating zone; and ground shields held by the housing and projecting beyond the top side of the base wall into the mating zone, each ground shield having a metal body that includes at least two walls connected to one another along edges thereof, each ground shield surrounding and electrically shielding a corresponding pair of the signal contacts on at least two sides thereof, wherein each of the ground shields has an inner side that faces the corresponding pair of signal contacts and an outer side that is opposite the inner side, wherein the outer sides of the ground shields have a lossy coating on the metal body along at least a majority of the surface area of the outer side to absorb electrical resonances, and wherein the inner sides of the ground shields lack the lossy coating.

13. The electrical connector of claim 12, wherein the lossy coating covers the metal body along an entirety of the surface area of the outer side of each of the ground shields.

14. The electrical connector of claim 12, wherein the lossy coating includes carbon particles therein, and has a higher resistivity than the metal body.

15. The electrical connector of claim 12, wherein the base wall of the housing is electrically conductive, and the metal bodies of the ground shields include dimples along the outer side that protrude outward, the dimples configured to physically engage the base wall within openings of the base wall to electrically connect the ground shields to the base wall, wherein the dimples along the outer side of the ground shields lack the lossy coating.

16. The electrical connector of claim 12, wherein the base wall of the housing is composed of a dielectric material, the lossy coating of the ground shields having a loss tangent that is greater than a loss tangent of the dielectric material of the base wall.

17. The electrical connector of claim 12, wherein the at least two walls of the ground shields includes a center wall, a first side wall, and a second side wall, the first side wall connected to a first edge of the center wall, the second side wall connected to a second edge of the center wall that is opposite the first edge, the first and second side walls generally extending parallel to one another in a common direction from the center wall such that the ground shields surround the corresponding pair of signal contacts on at least three sides.

18. The electrical connector of claim 12, wherein the housing includes shroud walls that extend beyond the top side of the base wall and define a cavity that represents the mating zone, wherein the signal contacts and the ground shields are arranged in an array of rows and columns within the cavity, the columns extending perpendicular to the rows.

19. An electrical connector comprising:

a housing including a base wall;

signal contacts arranged in pairs and held by the housing, the signal contacts projecting beyond a top side of the base wall into a mating zone; and ground shields held by the housing and projecting beyond the top side of the base wall into the mating zone, each ground shield having a metal body that includes a center wall, a first side wall, and a second side wall, the first side wall connected to a first edge of the center wall, the second side wall connected to a second edge of the center wall that is opposite the first edge, the first and second side walls generally extending parallel to one another in a common direction from the center wall, each ground shield surrounding and electrically shielding a corresponding pair of the signal contacts on at least three sides;

wherein each of the ground shields has an inner side that faces the corresponding pair of signal contacts and an outer side that is opposite the inner side, wherein the outer sides of the ground shields have a lossy coating on the metal body along an entirety of the surface area of the outer side to absorb electrical resonances, wherein the inner sides of the ground shields lack the lossy coating.

20. The electrical connector of claim 19, wherein the lossy coating covers the metal body at the outer side of each of the ground shields along an entire length of the ground shield from a mating end of the ground shield to a mounting end of the ground shield, and the inner side of the ground shield lacks the lossy coating along the entire length of the ground shield.

* * * * *